United States Patent [19]

Doern

[11] 4,411,281

[45] Oct. 25, 1983

[54] HAIRDRESSING DEVICE FOR STYLING, WINDING AND DRYING HAIR

[75] Inventor: Klaus Doern, Essen-Bredeney, Fed. Rep. of Germany

[73] Assignee: Wik Elektro-Hausgerate Vertriebsgesellschaft mbH & Co., Productions-KG, Essen, Fed. Rep. of Germany

[21] Appl. No.: 402,822

[22] Filed: Jul. 28, 1982

[30] Foreign Application Priority Data

Feb. 9, 1982 [DE] Fed. Rep. of Germany ..... 3204469

[51] Int. Cl.[3] ..... A45D 2/24

[52] U.S. Cl. ..... 132/37 R; 219/225

[58] Field of Search ..... 132/37 R, 11 A, 40, 132/145, 151, 51; 219/225

[56] References Cited

U.S. PATENT DOCUMENTS 1,643,168 9/1927 Nevotti ..... 132/151 X 2,618,276 11/1952 Hamparson et al. ..... 132/151 X 3,275,007 9/1966 Thackeray ..... 132/151 X

*Primary Examiner*—Gregory E. McNeill

*Attorney, Agent, or Firm*—Hume, Clement, Brinks, Willian & Olds, Ltd.

[57] ABSTRACT

The invention is an improvement in a hairdressing device for the styling, winding and drying of hair. The device includes a handle and a round brush. The round brush includes bristle rows, the bristles of which penetrate an outer tube and, through relative rotary movement between the outer tube and an inner tube, are either extended through the outer tube or lowered onto the surface of the inner tube within the outer tube. The handle is provided with a depressable operating key. Depressing the key turns the tubes through a predetermined angle of rotation relative to each other to achieve retraction of the bristles. A restoring spring interconnects the tubes. When the operating key is released the spring returns the tubes to their starting position and extends the bristles. A locking cam on the key prevents inadvertent retraction.

8 Claims, 9 Drawing Figures

HAIRDRESSING DEVICE FOR STYLING, WINDING AND DRYING HAIR

FIELD OF THE INVENTION

This invention relates to a hairdressing device for styling, winding and drying hair. It relates particularly to a device of the type comprising a handle a co-axial, round brush with bristles uniformly distributed on its circumference, and a heating element.

BACKGROUND OF THE INVENTION

Hairdressing devices of this type are known in which the brush includes relatively rotatable outer and inner tubes. Rows of bristles are provided inside the outer tube, mounted so that they may swing outwardly on the inner tube. Through rotary movement of the outer tube, effected with the aid of a handle connected to the free end of the outer tube, the bristles are made to extend outwardly through openings in the outer tube or retracted through the openings to lie on the circumference of the inner tube.

In an alternative known construction an operating ring is arranged between the outer tube and the handle. Rotation of the handle in one direction or the other causes the operating ring to extend or retract the bristles.

These two known types of hairdressing devices have distinct disadvantages. They are clumsy to operate. If the handle is joined rigidly to the outer tube two-handed operation is required for turning the outer tube. Where an operating ring is arranged between the outer tube and the handle the device is also difficult to operate, at least in the case where a strand or rolled lock of hair is on the brush.

SUMMARY OF THE INVENTION

An object of the invention is to provide an improvement in a hairdressing device for styling, winding and drying hair. Another object is to provide an improvement in a hairdressing brush with retractable bristles which is characterized by simple and fast operation with one hand. Still another object is to provide an improvement in a hairdressing device which avoids the disadvantages of the prior art brushes which have been discussed.

The foregoing and other objects are realized in accord with the present invention by providing two embodiments of a hairdressing device having a brush with retractable and extendable bristles. In each embodiment rows of bristles are mounted in longitudinal grooves on the outer surface of an inner tube, extending parallel to the axis of the inner tube. Radially extending openings are formed in the outer tube through which the bristles are adapted to extend into erect positions. The inner and outer tubes are rotatable relative to each other on their common axis.

In one embodiment of the invention the handle of the brush is provided with a depressable operating key carrying an operating cam. The operating cam works against a follower member on the outer tube, the follower member being rotatable mounted on the inner tube, the latter being fixed to the handle. The follower member turns the outer tube through a predetermined angle of rotation and causes the bristles to retract through the aforementioned apertures in the outer tube to a position where they lie circumferentially in receiving slots on the outer surface of the inner tube. As the outer tube is rotated by the actuating member under the influence of the operating key, a restoring spring is loaded. When the operating key is released, the restoring spring causes the outer tube to rotate in the opposite direction and the bristles to pass through the aforementioned apertures in the outer tube again to their erect or extended relationship.

In another embodiment of the invention the outer tube is fixed. There is provided, on the handle, a depressable operating key with an operating cam which engages a follower member. The follower member is fixedly mounted on the inner tube, which is rotatably mounted in the fixed outer tube. The operating key turns the inner tube through a predetermined angle of rotation which accomplishes the retraction of the bristles. As it does this, it compresses a restoring spring which is connected to the inner tube. On release of the operating key the restoring spring rotates the inner tube back to its starting position and the bristles are erected through the aforementioned apertures in the outer tube. This embodiment of the invention has the advantage that there is no movement between the outer tube and the handle and, accordingly, hair cannot get caught between the outer tube and the handle.

In both hairdressing devices embodying features of the present invention it is not necessary to have a turnable handle or a turning ring. A simple pushbutton and one finger is all that is needed to turn the outer tube relative to the inner tube and retract the bristles. Reestablishing the bristles in their extended position takes place automatically when the operating key is released.

The invention also contemplates that the device be locked in its unactuated position by a locking cam. The locking cam moves into position to conditionally prevent retraction of the extended bristles. The cam lock is released by simple pressure on the operating key when retraction of the bristles is desired.

DESCRIPTION OF THE PREFERRED EMBODIMENTS

Figure 1:
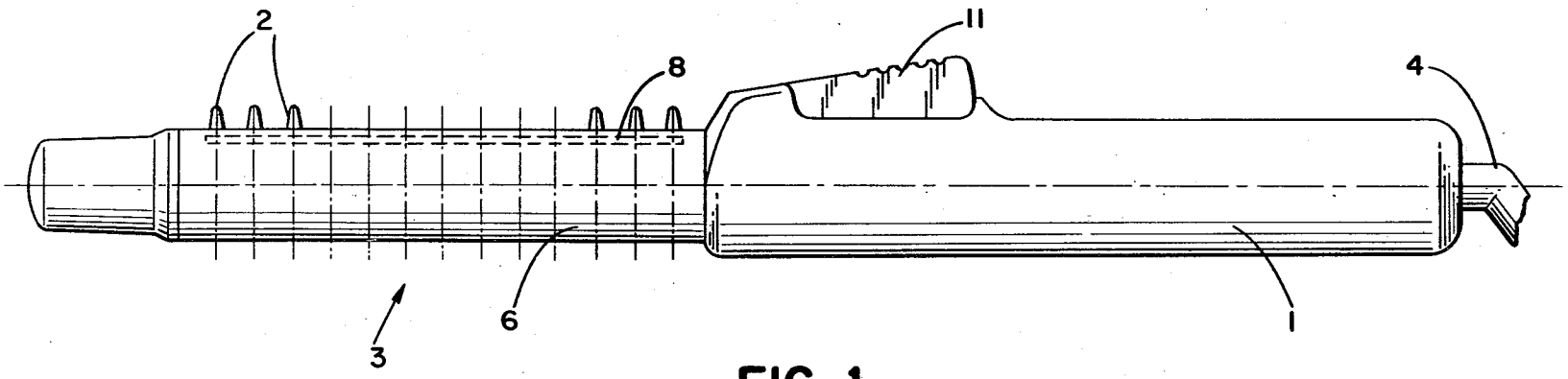
FIG. 1 illustrates a hairdressing device embodying features of the present invention, in schematic representation.

Referring now to the drawings, and particularly to FIG. 1, a hairdressing brush for styling, winding and drying hair, embodying features of the present invention, is illustrated. The brush includes a handle 1 and a round brush section 3 about which bristles 2 are uniformly distributed. The round brush section 3 is heated in a conventional manner by an electric heating unit (not shown) through electric wires 4 from a suitable source of power (not shown).

Referring also to FIGS. 2–5, a first embodiment of the invention is illustrated in greater detail. There it will be seen that the round brush section 3 comprises an inner tube 5 arranged inside and on the same axis as an outer tube 6. The inner tube 5 has longitudinally extending grooves 7 formed in evenly spaced relationship on the outer surface of the tube, extending parallel to the aforementioned axis.

A strip 8 of interconnected bristles 2 is seated in each of the longitudinal grooves 7. The outer tube 6 has radially disposed openings 9 formed through it. Axially aligned with these openings 9, the inner tube has circumferential slots 10 formed in its outer surface. Through relative rotary movement between the inner tube 5 and the outer tube 6 the bristles 2 are extended into upright position through the openings 9 in the outer tube and retracted inside the outer tube to positions where they lie in corresponding circumferential slots 10.

Figure 2:
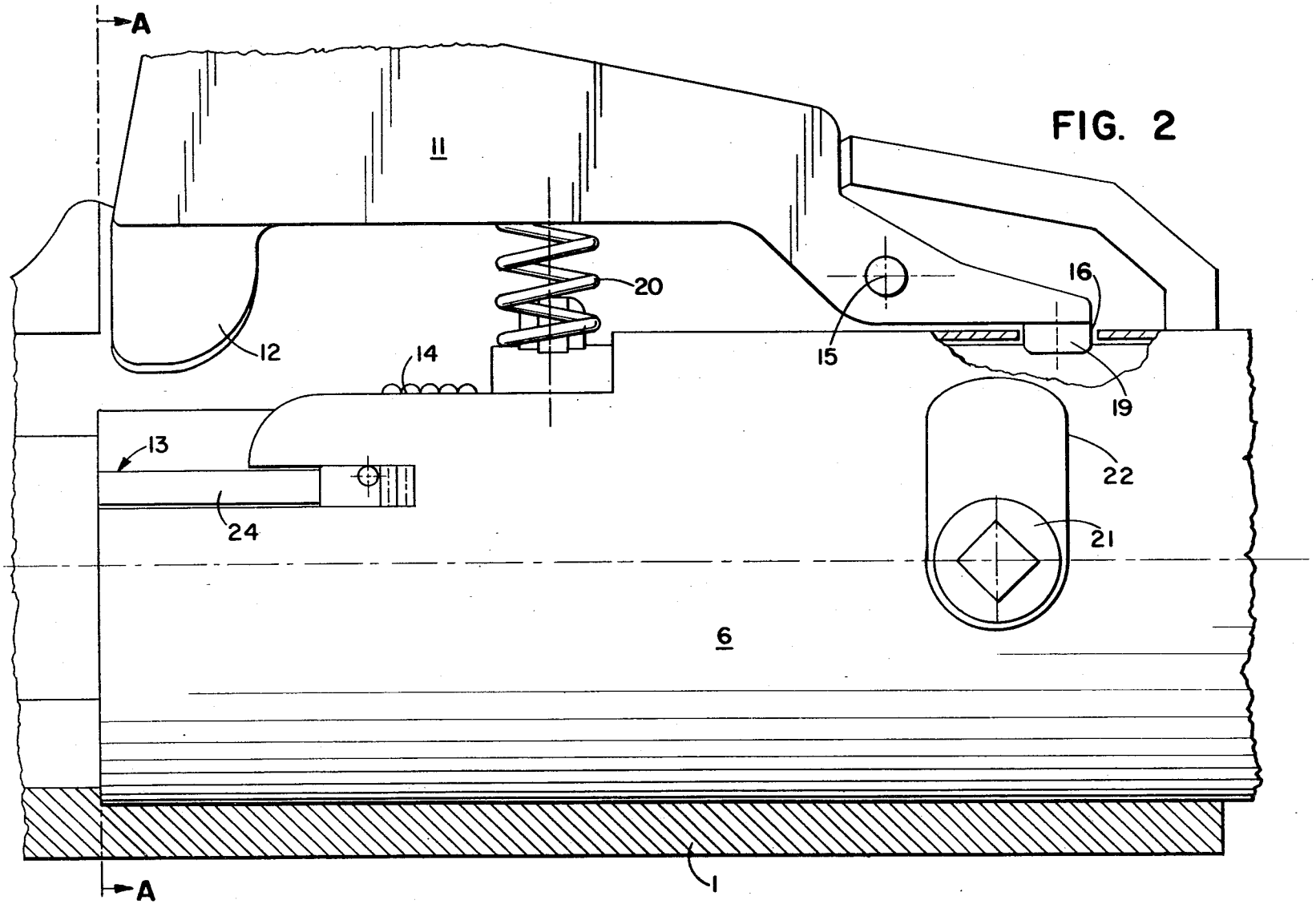
FIG. 2 is an enlarged view of a portion of the device illustrated in FIG. 1, in the area of the operating key, illustrating the first embodiment of the invention with a rotatable outer tube.
Figure 3:
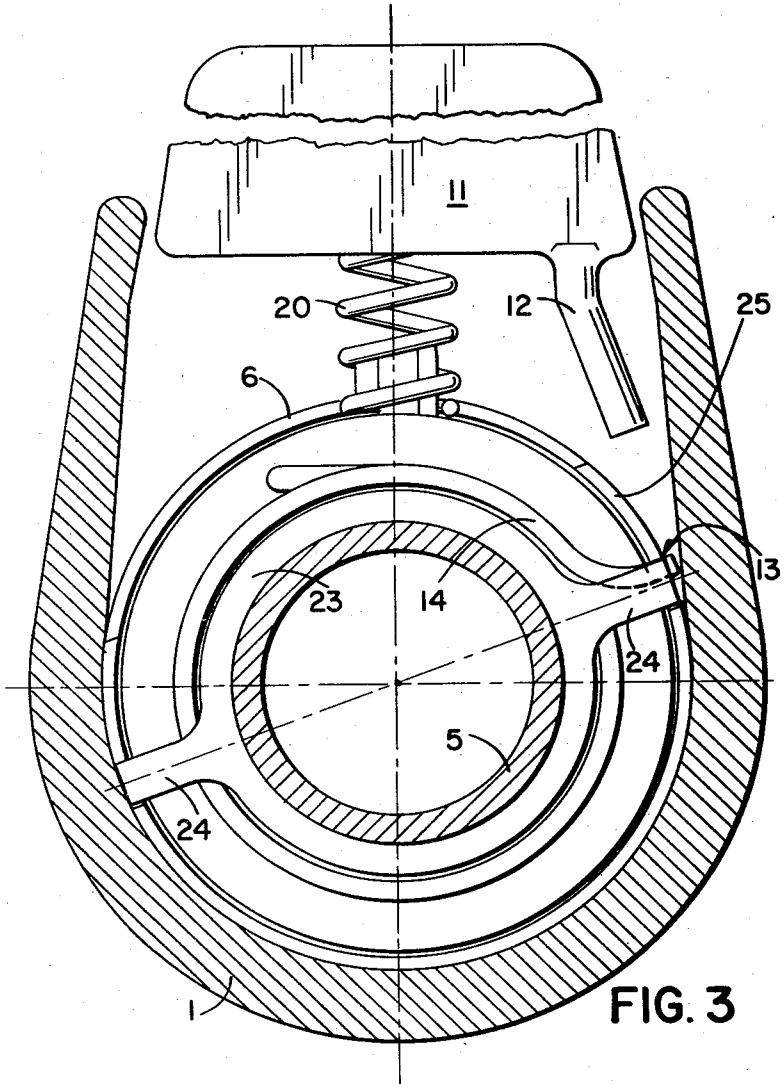
FIG. 3 is a vertical section taken along line A—A of FIG. 2.

Referring specifically to FIGS. 2 and 3, the handle 1 carries a depressable operating key 11 having an operating cam 12. The operating key 11 is mounted on the handle 1 for pivotal movement on the axis 15. Depression of the operating key 11 by the operator causes the cam 12 to engage a follower member 13.

The follower member 13 is rotatably mounted on the fixed inner tube 5. The follower member 13 is a ring 23 rotatable on the inner tube 5, the ring 23 having diametrically opposed, radially extending wings 24 formed thereon. One of the wings 24 extends radially into a slot formed in the outer tube 6, as best seen in FIG. 2.

A helical restoring spring 14 also encircles the inner tube 5. One end of the helical spring 14 is fixed to the inner tube 5 while the other end is seated in the aforementioned slot, adjacent the wing 24 seen in FIG. 2.

Figure 4:
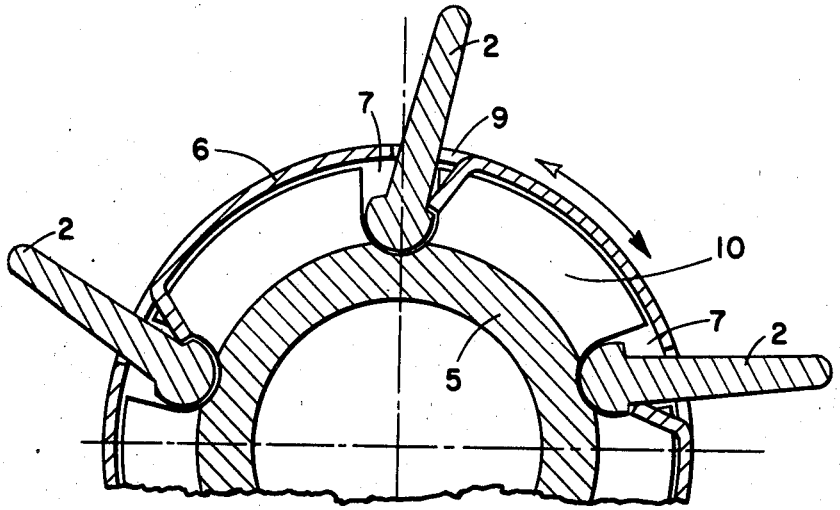
FIG. 4 is a partial vertical section through the brush body of the device of FIG. 1, with bristles extended.
Figure 5:
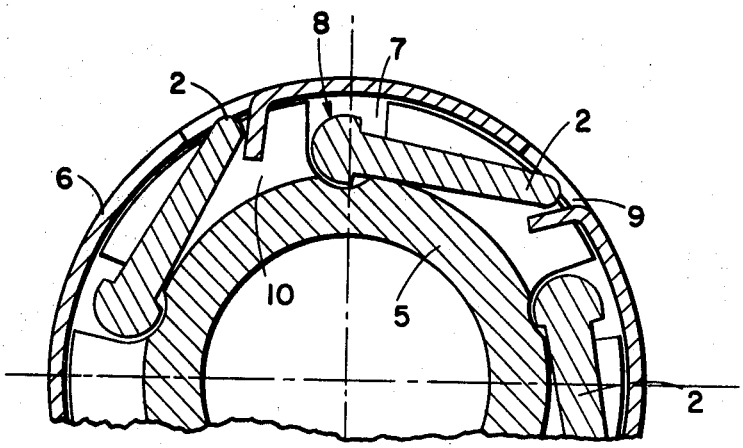
FIG. 5 is a partial vertical section similar to FIG. 4, but with retracted bristles.

When the operating key 11 is depressed its cam 12 presses downwardly on one wing 24 of the follower member 13, rotating both the ring 23 and the outer tube 6 in a clockwise direction in FIG. 3, relative to the inner tube 5. Prior to actuation the bristles 2 are in their extended, upright position, as seen in FIG. 4. Rotation of the outer tube 6 causes the bristles strips 8 to lie on their sides, as illlustrated in FIG. 5, with the bristles 2 retracting through openings 9 in the outer tube 6.

Rotation of the outer tube 6 relative to the inner tube 5 under the influence of the operating key 12 serves also to wind up the coil spring 14. When the oerating key 11 is released the coil spring 14 is effective to return the outer tube 6 to its starting position, automatically returning the bristles 2 to their extended position.

The operating key 11 is pivotably mounted on the handle 1 for rotation about the horizontal axis 15, as has previously been pointed out. On the end of the operating key 11 opposite the operating cam 12 a locking cam 19 is provided. The locking cam 19 is adapted to be received through a locking recess 16 in the rotatable outer tube 6, as seen in FIG. 2. Opposite the horizontal axis 15 the operating key 11 is supported by a coil spring 20. Accordingly, the operating key 11 is normally urged by the coil spring 20 to force the locking cam 19 into locking relationship with the outer tube 6, with the bristles 2 in their extended position. As such, the outer tube 6 cannot rotate nor the bristles 2 be retracted inadvertently, i.e., without depressing the key 11 which automatically removes the locking cam 19 from the recess 16.

The fixed inner tube 5 carries a stop 21 for limitating the angle of rotation of the rotatable outer tube 6. The stop 21 is a radial projection on the fixed inner tube 5. The stop 21 extends into a circumferentially elongated hole 22 formed in the rotatable outer tube 6. The length of the hole 22 corresponds to the angle of rotation which is desired for the outer tube 6, relative to the inner tube 5.

As has previously been pointed out, the follower member 13 comprises a ring 23 which is rotatably mounted on the fixed inner tube 5, i.e., on a rearwardly disposed section of the inner tube 5, within the handle 1. As seen in FIG. 3, a cutout 25 formed in the rotatable outer tube 6 permits access to the one wing 24 of the follower member 13 by the operating cam 12.

Referring now to FIGS. 6 to 9, the details of construction of the second embodiment of the invention are illustrated. There it will be seen that a depressable operating key 11 is also mounted on the handle 1 for pivoting movement about an axis 15. The operating key 11 carries an operating cam 12 which, when the key 11 is depressed, engages a follower member 13 rigidly fixed to the inner tube 5.

The outer tube 6 is fixed to the handle 1. Depression of the operating key 11 causes its cam 12 to engage the follower member 13 and rotate the inner tube 5 through a predetermined angle of rotation to retract the bristles 2 from the position seen in FIG. 8 to the retracted position seen in FIG. 9.

Figure 6:
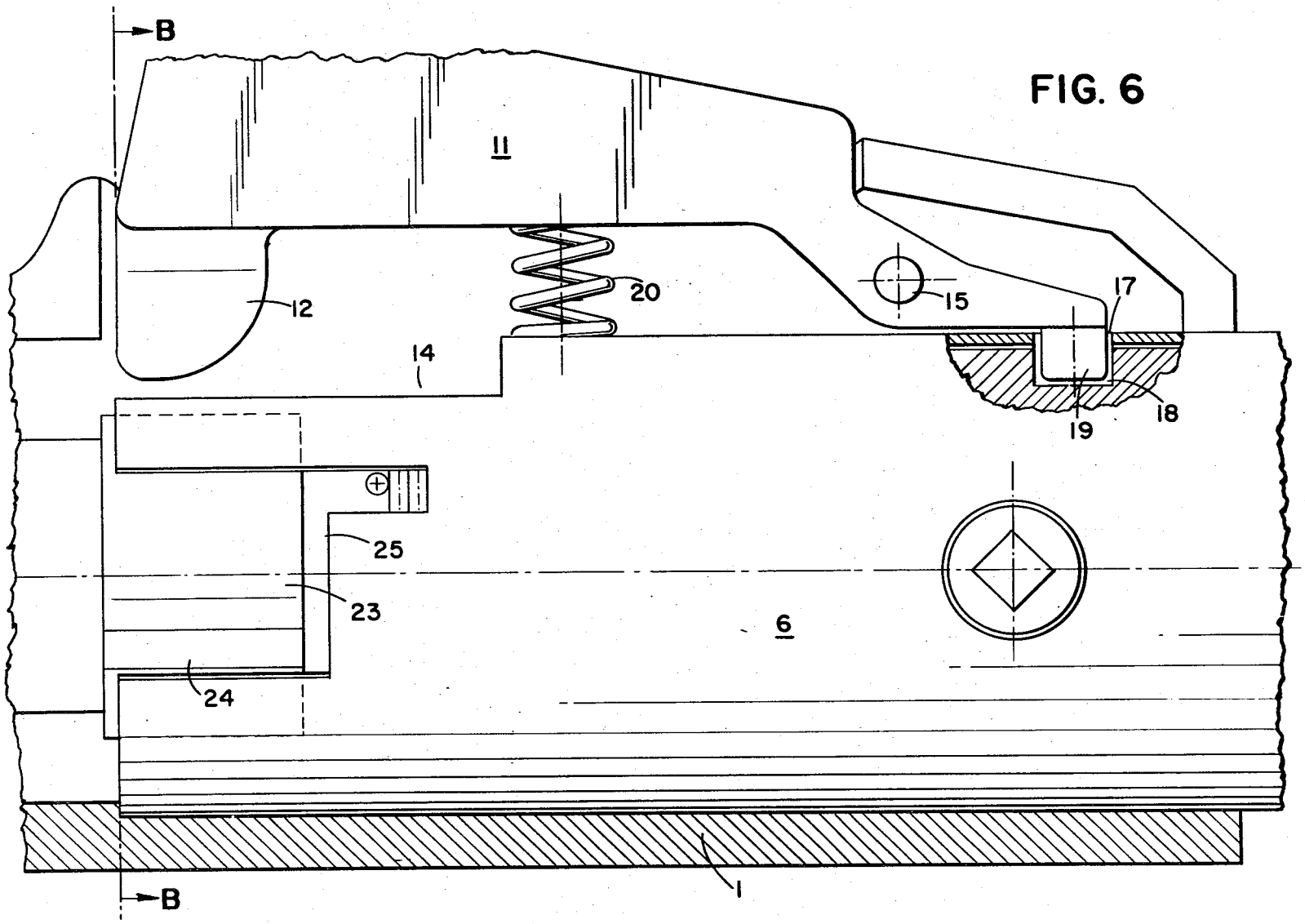
FIG. 6 is an enlarged view of a portion of the device illustrated in FIG. 1, in the area of the operating key, illustrating a second embodiment of the invention with a rotatable inner tube.
Figure 8:
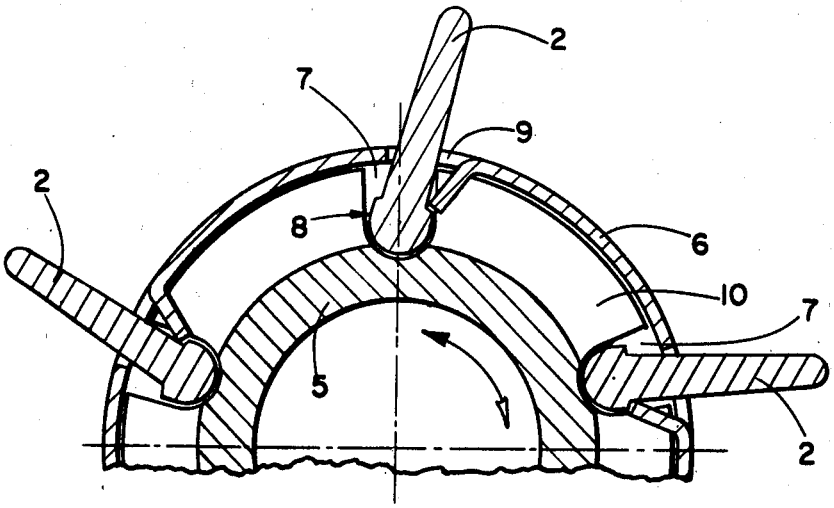
FIG. 8 is a partial section through the second embodiment brush body, with bristles erect.
Figure 9:
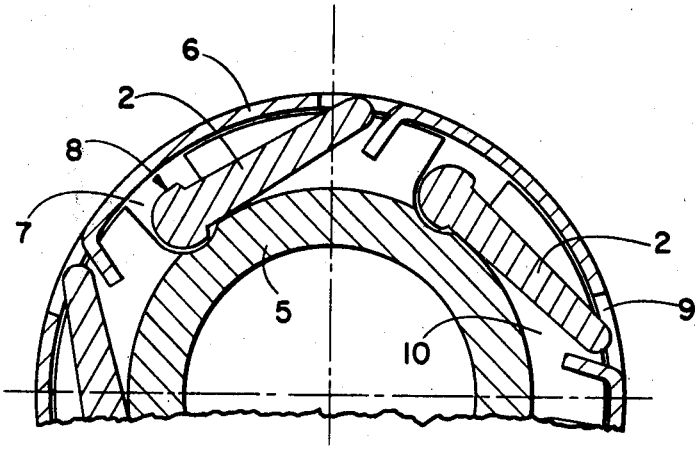
FIG. 9 is a partial vertical section similar to FIG. 8 with the bristles retracted.

A helical restoring spring 14 encircles the inner tube 5 and has one end of the spring affixed thereto. The opposite end of the spring 14 extends radially into a slot in the fixed outer tube, as seen in FIG. 6.

Figure 7:
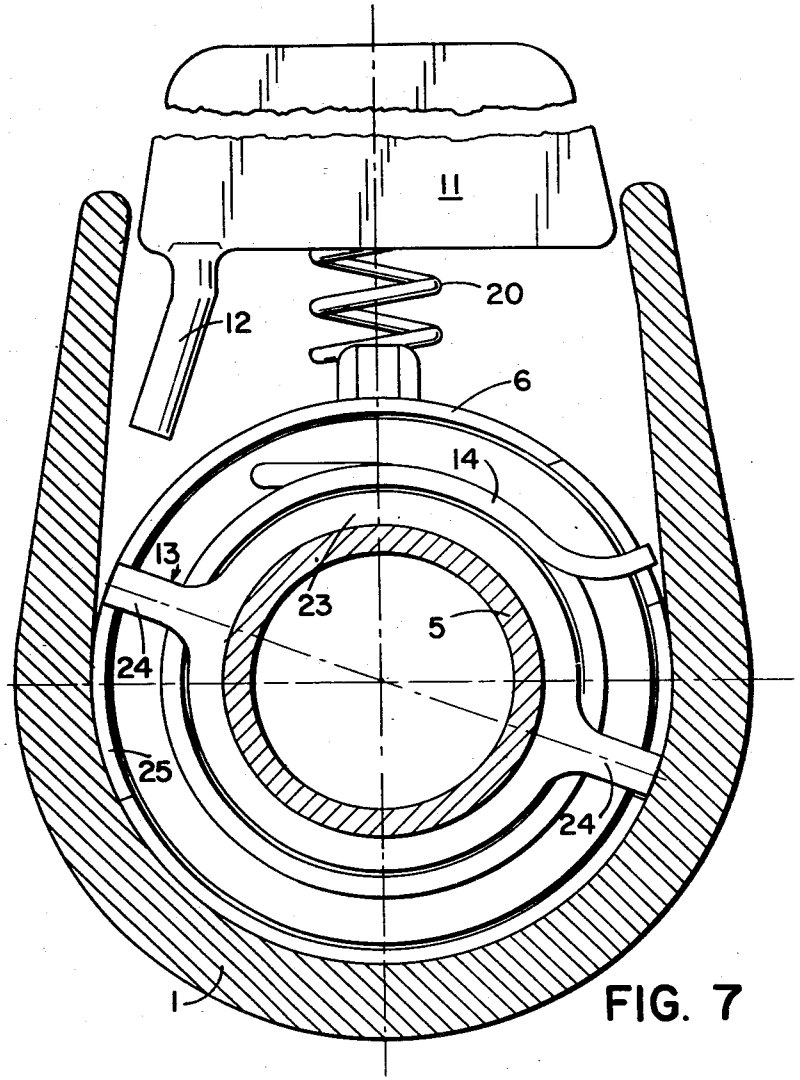
FIG. 7 is a sectional view taken along line B—B of FIG. 6.

The follower member 13 again comprises a ring 23 having radially extending wings 24. As seen in FIG. 7, these radial wings 24 on the ring 23 affixed to the rotatable inner tube 5 jut out into cutouts 25 in the fixed outer tube 6. The circumferential dimension of the cutouts 25 limits the angle of rotation of the inner tube 5 within the fixed outer tube and, at the same time, one of the cutouts 25 defines an opening through which the actuator cam 12 can move to engage the follower member 13. In this embodiment, therefore the radial wings 24 serve as stops for limiting rotation of the inner tube 5 in the fixed outer tube 6.

Like the embodiment of the invention shown in FIG. 2, the second embodiment incorporates a locking cam 19 on the operating key 11, opposite the axis 15. The locking cam 19 normally extends through an opening 17 in the fixed outer tube 6 into a locking recess 18 in the rotable inner tube 5. Accordingly, the device is normally locked in a position with the bristles 2 extended until the operating key 11 is depressed, preventing inadvertent rotation of the inner tube 5 and retraction of the bristles.

While several embodiments described herein are at present considered to be preferred, it is understood that various modifications and improvements may be made therein, and it is intended to cover in the appended claims all such modifications and improvements as fall within the true spirit and scope of the invention.

I claim:

1. In a hairdressing device having a handle and a round brush presenting bristles distributed on its circumference, the round brush including an inner tube, an outer tube and, on the inner tube, rows of bristles swingably mounted, the bristles penetrating the outer tube to an extended position or being retracted within the outer tube by relative rotary movement between the inner tube and the outer tube, the improvement comprising:

(a) a depressable operating key mounted on the handle and having an operating cam;

(b) said operating cam being effective, when the operating key is depressed, to act against a follower member mounted on said inner tube and rotate said follower member, rotation of said follower member being effective to rotate one of said inner and outer tubes relative to the other of said inner and outer tubes; and (c) a restoring spring connecting said inner and outer tubes;

(d) release of said operating key permitting said spring to reset said outer tube to a starting position relative to its said inner tube and effect the extension of said bristles through said outer tube.

2. The improvement in a hairdressing device of claim 1 further characterized in that:

(a) said inner tube is fixed to said handle.

3. The improvement in a hairdressing device of claim 1 further characterized in that:

(a) said outer tube is fixed to said handle.

4. The improvement in a hairdressing device of claim 1 further characterized by including:

(a) stop means disposed between said inner and outer tubes effective to limit relative rotational movement between said tubes.

5. The improvement in a hairdressing device of claims 2 or 3 further characterized in that:

(a) said restoring spring comprises a helical spring encircling said inner tube within said outer tube.

6. The improvement in a hairdressing device of claim 3 further characterized in that:

(a) said follower member comprises wing means fixed against rotational movement relative to said inner tube but not fixed against rotational movement relative to said outer tube;

(b) said wing means acting as stop means for limiting relative movement between said tubes and an engagement means for said operating cam.

7. The improvement in a hairdressing device of claim 2 further characterized in that:

(a) said follower member comprises a ring encircling said inner tube;

(b) said ring being mounted on said inner tube for rotational movement relative thereto;

(c) said ring having wing means extending radially therefrom;

(d) said wing means acting as engagement means for said operating cam; and (e) stop means between said tubes for limiting relative rotational movement therebetween.

8. The improvement in a hairdressing device of claims 2 or 3 further characterized in that:

(a) the operating key is swingably borne about a horizontal axis on the handle above the outer tube and includes a locking cam;

(b) an opening in the outer tube for receiving said locking cam; and (c) a spring urging said locking cam into said opening.

* * * * *